US006564478B1

(12) United States Patent
Wing et al.

(10) Patent No.: US 6,564,478 B1
(45) **Date of Patent: *May 20, 2003**

(54) COMPACTIBLE SNOWHOES

(75) Inventors: Harold R. Wing, Springville, UT (US); N. Ryan Moss, Mapleton, UT (US); David Francis, Orem, UT (US)

(73) Assignee: Wing Enterprises, Inc., Springville, UT (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/642,718

(22) Filed: Aug. 21, 2000

Related U.S. Application Data

(63) Continuation of application No. 09/061,995, filed on Apr. 17, 1998, now Pat. No. 6,105,281, which is a continuation of application No. 08/536,692, filed on Sep. 29, 1995.

(51) Int. Cl.[7] ..... A43B 5/04; A43B 5/16
(52) U.S. Cl. ..... 36/122; 36/123
(58) Field of Search ..... 36/122, 123, 124, 36/125

(56) References Cited

U.S. PATENT DOCUMENTS

| | | | | |
|---|---|---|---|---|
| 3,344,538 A | | 10/1967 | Massicotte | 36/4.5 |
| 3,484,958 A | * | 12/1969 | Novak | |
| 3,744,162 A | | 7/1973 | Beck | 36/2.5 AB |
| 3,927,896 A | | 12/1975 | Detoia | 280/11.13 C |
| 4,041,621 A | * | 8/1977 | Anderson | 36/122 |
| 4,203,236 A | * | 5/1980 | Erickson et al. | 36/123 |
| 4,348,823 A | | 9/1982 | Knapp et al. | 36/123 |
| 4,720,927 A | * | 1/1988 | Abegg | 36/122 |
| 5,259,128 A | * | 11/1993 | Howell | 36/122 |
| 5,309,652 A | * | 5/1994 | Campbell | 36/124 |
| 5,398,957 A | | 3/1995 | Leighton et al. | 280/600 |
| 5,459,950 A | * | 10/1995 | Damm et al. | 36/122 |
| 5,740,621 A | * | 4/1998 | Wing et al. | 36/122 |
| 6,105,281 A | * | 8/2000 | Wing et al. | 36/122 |

FOREIGN PATENT DOCUMENTS

| | | |
|---|---|---|
| CA | 0531672 | 10/1956 |
| CA | 0906522 | 8/1972 |

OTHER PUBLICATIONS

Campmor Gift Catalog 1994, p. 61.
Mountain Gear Winter Catalog 1995, p. 14.
Swallows' Nest 1994 Holiday Gift Catalog, p. 13.
Cabella's Christmas 1994 Catalog, p. 216.
1995 Ramer Adventure Skiing Catalog, Ramer Assault Snowshoe.

* cited by examiner

*Primary Examiner*—M. D. Patterson
(74) *Attorney, Agent, or Firm*—TraskBritt

(57) ABSTRACT

A snowshoe having both a compact stored configuration and a usable configuration is disclosed. A frame of the snowshoes includes a plurality of segments which can be disconnected from each other, folded upon each other, or telescopically inserted into one another thus allowing the frame to be collapsed to a fraction of its original size when not being used. When collapsed the effective length of the frame members is greatly reduced. The frame can be readily assembled and disassembled. The frame is fabricated from a material which is both lightweight and strong. Also disclosed is a snowshoe binding structure which is also lightweight and compactible to a small size and particularly suited for use with a compatible snowshoe. A deck, fabricated from a flexible material, is coupled to the frame during use and is removed when the frame is compacted for storage. When in its compact storage configuration the snowshoe components are arranged in an easily stored bundle.

19 Claims, 13 Drawing Sheets

COMPACTIBLE SNOWHOES

RELATED APPLICATIONS

This application is a continuation of and claims priority to co-pending U.S. patent application Ser. No. 09/061,995, filed Apr. 17, 1998, and entitled COMPACTIBLE SNOWSHOES, which is incorporated herein by reference, and which is a continuation of application Ser. No. 08/536,692, filed Sep. 29, 1995, and entitled COMPACTIBLE SNOWSHOE AND BINDINGS AND METHOD OF ASSEMBLY, which is incorporated herein by reference.

BACKGROUND

1. The Field of the Invention

This invention relates to devices used for snow country survival. More particularly, the invention relates to snowshoes.

2. The Background Art

Snowshoes are essential when walking across deep snow any substantial distance. Many people who regularly travel in snow covered country via motor vehicle, snowmobile, and even small aircraft carry snowshoes in the event they become stranded due to an accident or mechanical failure and must walk out across deep snow to obtain assistance.

Full size snowshoes are generally too large to conveniently store in a motor vehicle or small aircraft for only emergency use. Moreover, full size snowshoes are coo large to conveniently carry on a snowmobile. Full size snowshoes may even present a collision hazard when lashed to a snowmobile if they extend over the sides of the snowmobile or when the lashing fails and they fall off the snowmobile onto the trail. A lone snowmobiler is particularly at risk when traveling in the snow covered back country. Having snowshoes ready for use when one would otherwise be stranded in deep snow can be a matter of life and death.

The previous attempts to provide a snowshoe for emergency use has not resulted in a suitable snowshoe which can be compactly stored, for example on a snowmobile, but also provides easy assembly and efficient operation. Importantly, the previously available attempts in the art to provide a snowshoe which can be collapsed to a smaller storage size disadvantageously produced snowshoes which are still too large to be conveniently stored, too small to work well in deep powder snow, not strong enough to withstand the rigors of hard use, inefficient during use, and/or too difficult to assemble or disassemble. Thus, it would be an advance in the art to provide a snowshoe which can be compactly stored when not being used, which can be easily assembled and which provides good performance in use.

BRIEF SUMMARY AND OBJECTS OF THE INVENTION

In view of the above described state of the art, the present invention seeks to realize the following objects and advantages.

It is a primary object of the present invention to provide a compactible snowshoe which can be conveniently stored until needed.

It is also an object of the present invention to provide a collapsible snowshoe which is particularly suitable for emergency use.

It is another object of the present invention to provide a compactible snowshoe which provides efficient and desirable performance when being used.

It is a further object of the present invention to provide a collapsible snowshoe which can be easily assembled and disassembled.

It is another object of the present invention to provide a collapsible snowshoe which is lightweight.

It is a further object of the present invention to provide a compactible snowshoe which is suitable for long distance travel.

It is yet another object of the present invention to provide a collapsible snowshoe which includes a snowshoe frame which is strong and rigid.

These and other objects and advantages of the invention will become more fully apparent from the description and claims which follow, or may be learned by the practice of the invention.

The present invention provides a snowshoe having both a compact stored configuration and a usable configuration. When in its compact stored configuration, the snowshoe is particularly adapted for storage until a situation arises requiring the use of the snowshoes. The snowshoes of the present invention include a frame comprised of a plurality of frame members or frame segments which can be disconnected from each other, folded upon each other, or telescopically inserted into one another thus allowing the frame to be compacted to a fraction of its original size when not being used. Each of the frame members may include one or more frame segments allowing the length of the frame members to be reduced when the snowshoe is collapsed for storage.

The embodiments of the present invention preferably include means for selectively interconnecting and disconnecting the frame members. Alternatively, embodiments of the present invention may include means for folding one or more of the frame members along their length to allow for compact storage. Furthermore, one or more of the frame members may comprise telescoping segments which extend and retract along their length for use and storage, respectively.

A rigid interconnecting member interconnects two of the side frame members to hold them a proper distance apart in a side-by-side relationship even when the weight of the user is bearing down on the snowshoe frame. In accordance with the present invention, the snowshoes are also particularly easy to assemble. Once the frame is assembled, a deck means is coupled to the frame and a tensioning means tightens the deck means so that it is held taut within the frame. The deck means is preferably fabricated from a flexible material and is formed to fit within the closed frame. The tensioning means includes a unitary member, for example a strap, which the users pull to tension the deck means. The unitary strap is a much easier and more efficient device to tension the deck than one or more laces which must be individually tightened and tied.

In order to provide the greatest benefit to the user, embodiments of the invention utilize light weight and high strength materials. Use of high strength and light weight materials provides a rigid and strong snowshoe and one which can be used for long distance travel while minimizing the user's fatigue. Moreover, the materials for the snowshoe frame, as well as other components of the snowshoe, are selected so that the volume occupied by the snowshoe when in its stored configuration is minimized.

In accordance with another aspect of the present invention, a snowshoe binding is also provided. One preferred arrangement for the snowshoe binding of the present invention includes a binding plate which is pivotally attached to the snowshoe frame. A user places his shoe or boot upon the binding so that the ball of the user's foot is approximately over the binding plate. A first strap and a second strap are each secured to the binding plate and means is provided for holding the first and the second straps in a crossed pattern over the instep of the user's foot. Also provided is a means for holding both the first and the second straps behind the heel of the user's foot. Means are provided for adjusting the length of the first strap and the second strap so the user's foot is secured therein. A cleat is provided on the binding plate and the binding plate pivots as the user steps. The preferred embodiments of the snowshoe binding of the present invention provides a binding which is light weight, strong, easy to use, and compact when not in use. Other binding structures can also be used with the snowshoe of the present invention.

When in its storage configuration, the components of the snowshoe can preferably be arranged in an easily stored bundle. When needed, the snowshoes of the present invention can be readily assembled and used.

BRIEF DESCRIPTION OF THE DRAWINGS

In order to better appreciate how the above-recited and other advantages and objects of the invention are obtained, a more particular description of the invention briefly described above will be rendered by reference to specific embodiments thereof which are illustrated in the appended drawings. Understanding that these drawings depict only typical embodiments of the invention and are not therefore to be considered limiting of its scope, the invention will be described and explained with additional specificity and detail through the use of the accompanying drawings in which.

DETAILED DESCRIPTION OF THE PREFERRED EMBODIMENTS

Reference will now be made to the drawings wherein like structures will be provided with like reference designations.

It will be appreciated that to be effective in deep, powder snow, snowshoes must provide a minimum surface area to support the weight of the person. Those skilled in the art will appreciate that if a snowshoe presents less than a minimum surface area to the underlying snow it will be ineffective to support the weight of a large person. Thus, the snowshoe of the present invention must meet two competing considerations: it must be small enough when disassembled to be conveniently stored and large when assembled to provide support for the user on the surface of the snow. If the snowshoe's performance is inadequate when assembled, the user's life may be jeopardized.

Figure 1A:
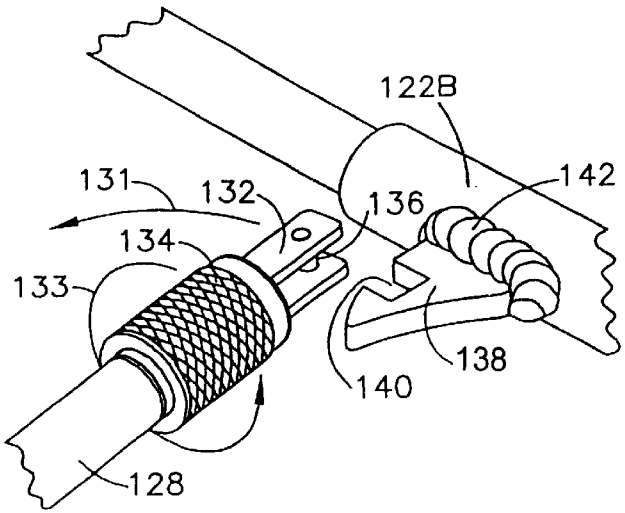
FIG. 1A is a detailed perspective view of the interconnecting member illustrated in FIG. 1.
Figure 1:
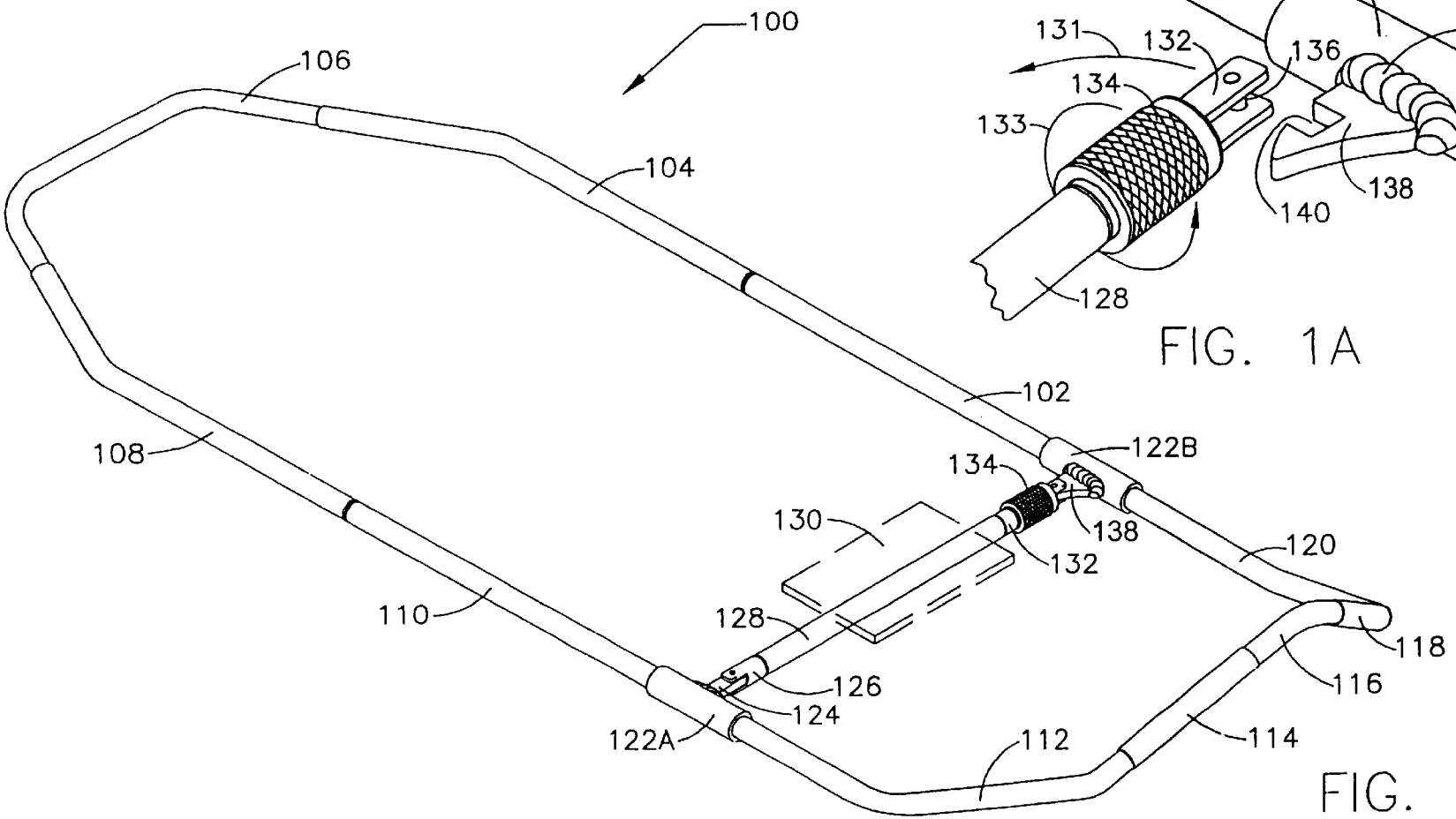
FIG. 1 is a perspective view of a snowshoe frame of the first presently preferred embodiment of the present invention.

Reference will first be made to FIG. 1 which is a perspective view of a snowshoe frame, generally designated at 100, which is used in the first presently preferred embodiment of the present invention. Critically, the preferred frame represented in FIG. 1 provides a strong frame which can withstand the rigors of hard use and which is large enough to provide a deck of sufficient surface area to support a person on the surface of the snow. The frame 100 provides these desirable features while being capable of collapsing to a small, compact bundle which can be conveniently stored on a snowmobile. Even further, the present invention advantageously provides a snowshoe which is small enough, when disassembled, to allow a pair of snowshoes to be permanently stored on a snowmobile until needed in an emergency situation. Similarly, the present invention provides a snowshoe which can be similarly stored in a backpack or in stationary emergency supplies until an emergency need arises.

As will be explained shortly, the frame 100 collapses to a small bundle which can be compactly stored. Previously available devices have not recognized the need to reduce the maximum disassembled length of the snowshoe frame to an extent which allows convenient storage on a snowmobile while retaining the necessary strength and ease of assembly.

Figure 2:
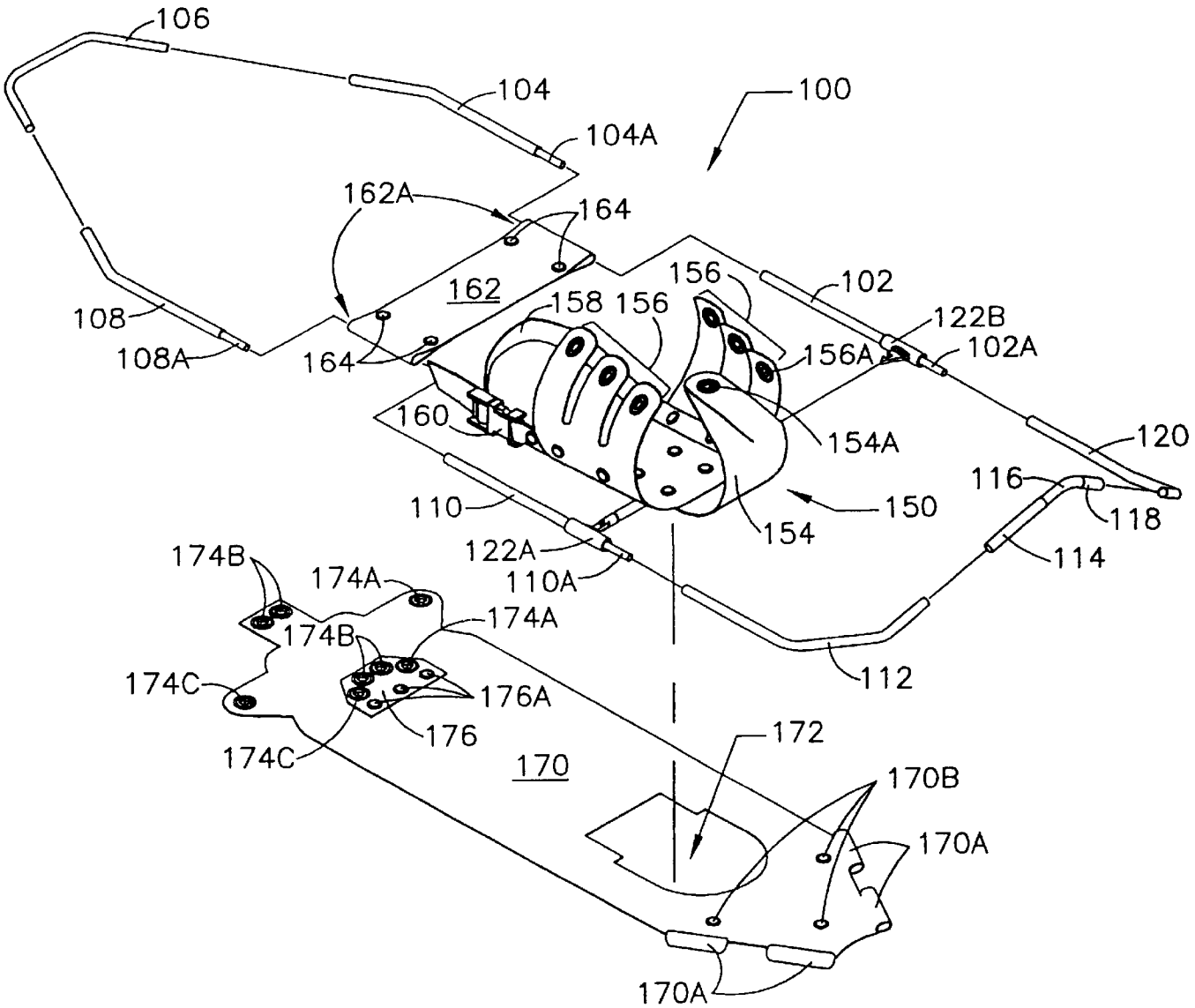
FIG. 2 is an exploded perspective view of the snowshoe frame illustrate in FIG. 1 with the deck, binding, and other components illustrated.

The frame 100 comprises two side frame members, each of the side members including three frame segments: a left side frame member including segments 120, 102 and 104 and a right side member including segments 112, 110 and 108 (the break between segments 120 and 102 and between segments 112 and 110 being seen best in FIG. 2). It is preferred that each of the frame segments 120, 102 and 104 and 112, 110 and 108 have a length in the range from about three inches to about eighteen inches with about ten inches being most preferred. Further information concerning the preferred lengths of the segments of the frame 100, and the other frames described herein, will be provided shortly. As will be understood from this disclosure, a frame member of the present invention may comprise only a single member or segment or may include a plurality of segments depending on the desired size of the frame members when disassembled.

It will be appreciated that different size frames will accommodate persons of different weight, namely, smallest frames will accommodate children with larger frames accommodating larger persons. Importantly, smaller persons find larger snowshoes unwieldy and the provision of smaller snowshoes is within the scope of the present invention.

Attached to the front end of the segments 120 and 112 are connecting tubes 118 and 114, respectively. A nose segment 116 joins together the connecting tubes 118 and 114 to complete the front member of the frame 100. A rear segment 106 functions as a rear frame member. With two side frame members, a front frame member, and a rear frame member the frame 100 forms a closed frame. It is preferred that the frame 100 form a closed polygon shape but it is within the scope of the present invention to utilize a frame of any shape which meets the desired performance requirements.

A rigid interconnecting member 128 is hingedly attached to the sleeves 122B and 122A. The sleeves 122B and 122A are attached to frame segments 102 and 110. A post 124 is welded to sleeve 122A and functions, in cooperation with clevis 126, as a hinge which allows the interconnecting member 128 to pivot from a position substantially perpendicular to the frame segment 110 to a position substantially parallel to the segment 110 as will be explained more fully later in this disclosure. One of the important functions of the interconnecting member 128 is holding the side frame members a predetermined distance apart. The hinged interconnecting member 128 also provides the important function of adding strength to the frame 100 thus allowing the remaining frame components to be less bulky and light weight. It will be appreciated that by hingedly or removably attaching the interconnecting member 128 to the side frame members provides such advantages. A binding plate 130, which will be described with greater detail shortly, is pivotally mounted to the interconnecting member 128 by members 130A.

The detailed view of FIG. 1A shows a latching mechanism which serves to secure the interconnecting member 128 to the sleeve 122B. A clevis 132 with a pin 136 is provided on the end of the interconnecting member 128. When assembled, the clevis 132 and pin 136 are received by a notch 140 provided on a post 138 which is preferably attached to the sleeve 122B by a weld 142.

With the clevis 132 and pin 136 free as shown in FIG. 1A, the interconnecting member 128 can swing in the direction of arrow 131. The interconnecting member 128 is locked into place when the pin 136 is received into the notch 140 and a cylindrical locking knob 134, which is threadably connected to the clevis 132, is rotated as indicated by arrow 133 which causes the cylindrical locking knob 134 to capture the clevis 132 and the post 138.

Preferred dimensions for the frame member segments illustrated in FIG. 1 are provided below in Table A. It is to be understood that such dimensions are also applicable to corresponding segments included in the frames illustrated in FIGS. 6 and 7.

TABLE A

| Member/ Segment | Preferred overall length | Most preferred overall length |
|---|---|---|
| 102 | ≈6 inches to ≈14 inches | ≈8 inches to ≈11 inches |
| 104 | ≈6 inches to ≈14 inches | ≈8 inches to ≈11 inches |
| 108 | ≈4 inches to ≈10 inches | ≈5 inches to ≈9 inches |
| 108 | ≈6 inches to ≈14 inches | ≈8 inches to ≈11 inches |

TABLE A-continued

| Member/ Segment | Preferred overall length | Most preferred overall length |
|---|---|---|
| 110 | ≈6 inches to ≈14 inches | ≈8 inches to ≈11 inches |
| 112 | ≈5 inches to ≈13 inches | ≈7 inches to ≈10 inches |
| 114/116/118 | ≈3 inches to ≈7 inches | ≈4 inches to ≈6 inches |
| 120 | ≈5 inches to ≈13 inches | ≈7 inches to ≈10 inches |

The frame 100 can be fabricated from any number of materials know to those skilled in the art and which provide the required strength and weight characteristics. It is presently preferred that the frame 100 be fabricated from a tubular material manufactured from an aluminum alloy which can be selected by those skilled in the art in accordance with the information set forth herein. Other materials can also be used within the scope of the present invention.

It will be appreciated that the weight of a snowshoe is critical to the user of the snowshoe. Every ounce added to a snowshoe is an extra ounce which the user must lift with each step. Thus, users of snowshoes look for the lightest weight snowshoe possible. Non-collapsible snowshoes lend themselves to the use of light weight materials. Thus, non-collapsible snowshoes providing a large surface bearing area can be relatively light weight. Significantly, many of the lightweight materials used in non-collapsible snowshoes are not suitable for use with collapsible snowshoes where the frame must be segmented and the deck material must be very flexible.

Figure 4:
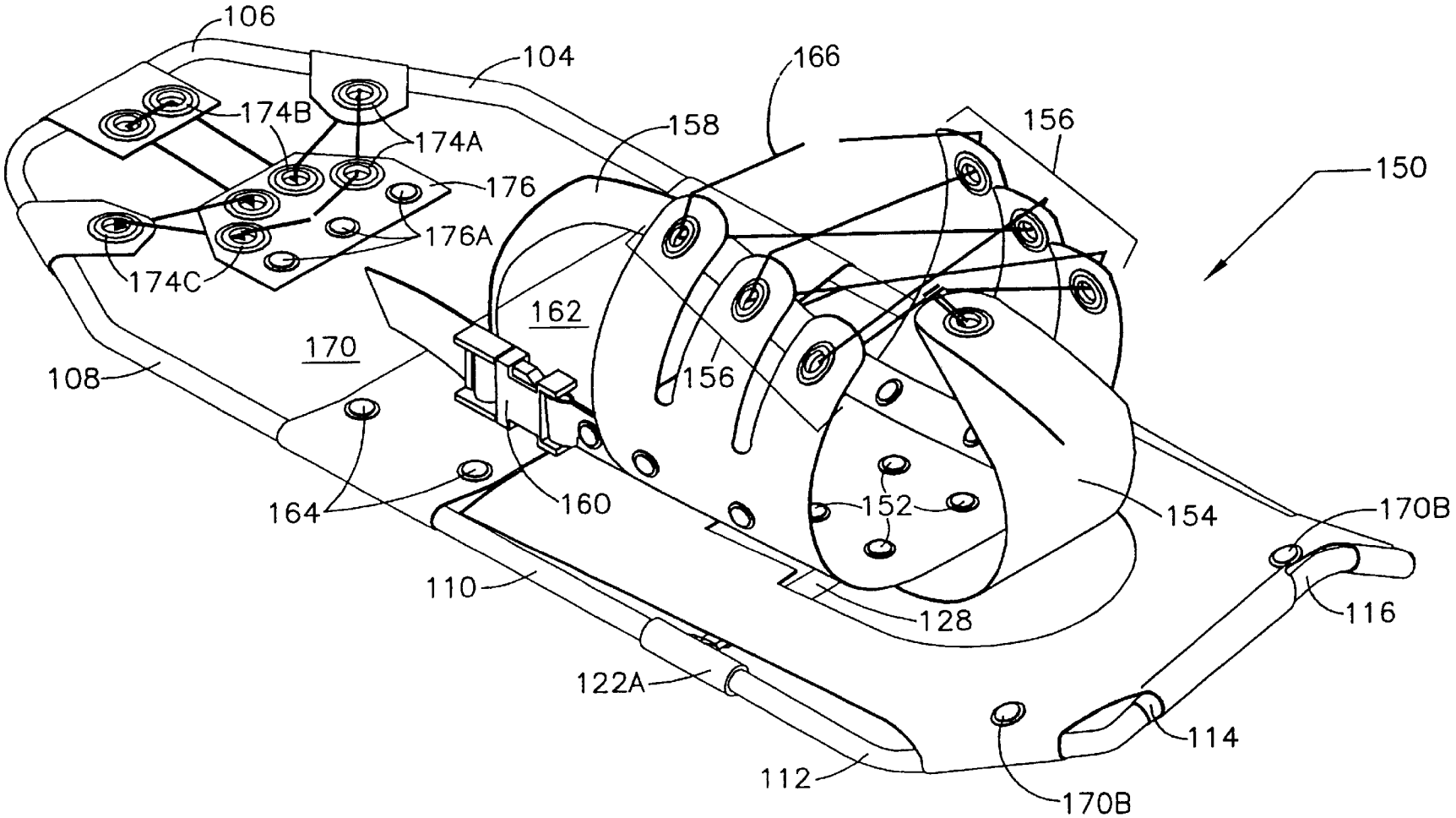
FIG. 4 is a perspective view of the fully assembled snowshoe using the frame and other components illustrated in FIGS. 1–3.
Figure 12:
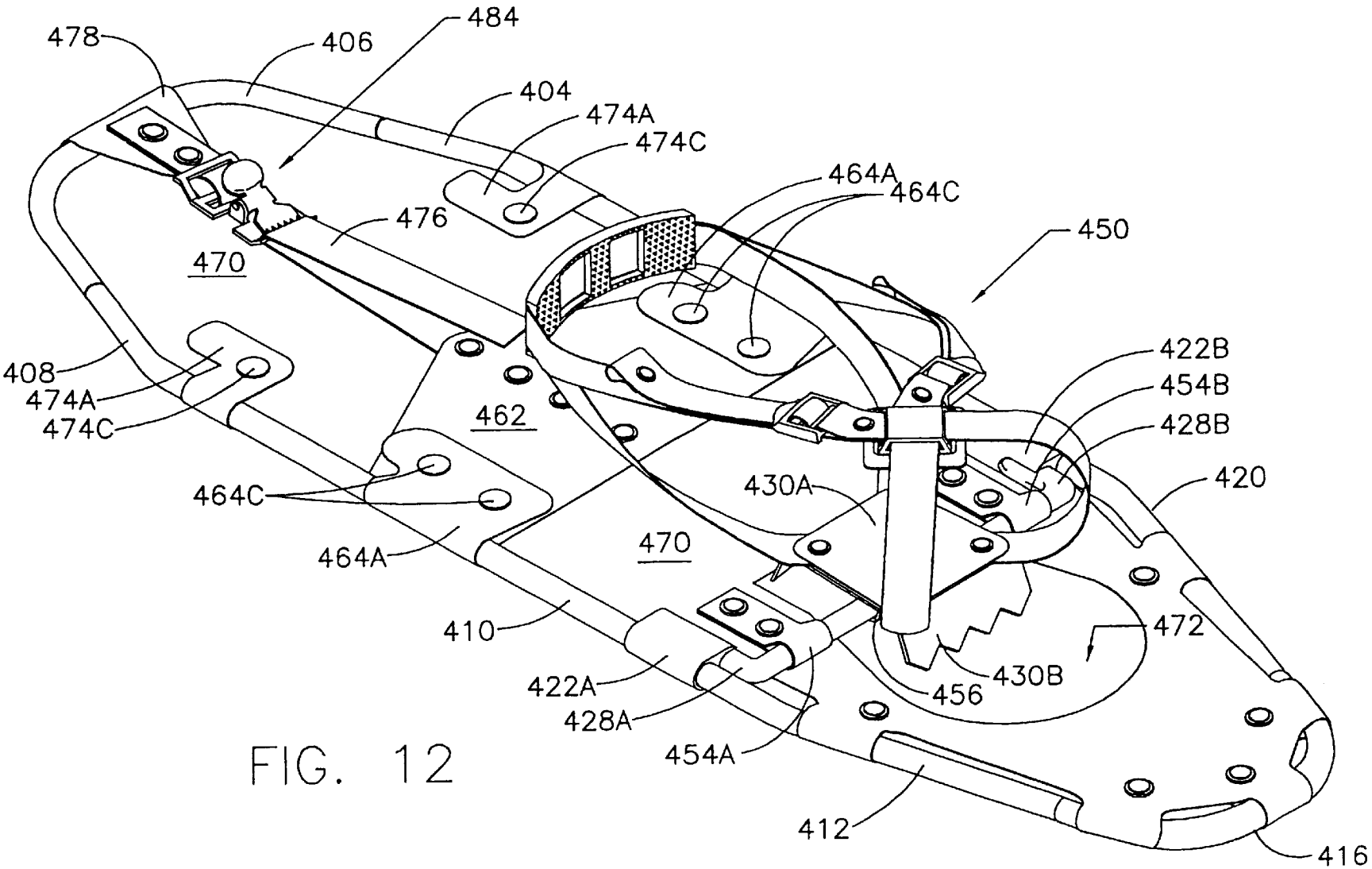
FIG. 12 is a perspective view of the coupled binding assembly, deck assembly, and snowshoe frame of the fourth presently preferred embodiment of the present invention ready to be used.

Previously available collapsible snowshoes, which utilize weaker materials, must be heavier than the snowshoes of the present invention. For example, the previously available collapsible snowshoes weigh about five pounds each, without a binding. Snowshoe bindings typically add one or more pounds to the total weight of the snowshoe. In contrast, the embodiments of the present invention as illustrated in FIGS. 4 and 12 preferably weigh less than about six pounds, more preferably weigh less than about five pounds, and most preferably weigh less than about 3.5 pounds. Every ounce of excess weight which is removed from a snowshoe increases the desirability of the snowshoe. Prior to the advent of the present invention, attempts at producing collapsible snowshoes generally ignored any concern for the weight of the snowshoe, possibly because of the assumption that the snowshoe would only be used for short trips. Importantly, by providing a snowshoe which combines ruggedness, rigidity, sufficient surface area with light weight provides a snowshoe which is well suited to long distance travel and which can also be compactly stored. In contrast, the previously available devices did not provide snowshoes which, because of their weight and other reasons, are not suitable for long distance travel.

The snowshoe frames illustrated in the figures can be fabricated in a variety of lengths. The preferred ranges of lengths for the snowshoe frames is preferred to be in the range from about fourteen inches to about thirty-six inches, more preferably in the range from about eighteen inches to about thirty inches, and most preferably in the range from about twenty inches to about thirty inches. Also, the snowshoe frames illustrated in the figures can be fabricated in a variety of widths. The preferred ranges of widths for the snowshoe frames is preferred to be in the range from about six inches to about twelve inches, more preferably in the range from about seven inches to about eleven inches, and most preferably in the range from about eight inches to about ten inches. Depending upon the characteristics of the user, for example, height, weight, stride length and so forth, different combinations of lengths and widths for the snowshoe frame can be selected. Also, a user may desire larger snowshoes if stability and load carrying capacity are paramount considerations. If speed and agility are paramount considerations, a smaller snowshoe may be selected. Thus, the size of the snowshoe frame may be selected in accordance with the end use in mind.

In order to provide the greatest benefits, the embodiments of the present invention must have suitable strength characteristics. In particular, the frame should be manufactured with materials having suitable strength. Utilizing materials for the frame which provide at least a minimum amount of strength allows the frame members to have a more compact configuration and smaller diameter as well as provide a more rigid, stiffer frame which is more efficient during use than a snowshoe with a flimsy frame.

The strength of a material, which can be a metal, a composite, a plastic, or some other material now available or available in the future, can be defined by one or more characteristics. Many materials which are commercially available as stock items have published strength characteristics. The determination of such characteristics for any particular material is best arrived at using testing, most often destructive testing.

Two of the most useful strength characteristics of materials suitable for use with the present invention are "yield strength" and "ultimate strength" also referred to as "tensile strength." As is known in the industry, the yield strength or yield point of a material is defined as the stress at which a marked increase in strain occurs without a concurrent increase in applied stress. Granet, I., Strength of Materials for Engineering Technology 65 (1985). The ultimate strength or tensile strength of a material is defined as the stress obtained by dividing the maximum load reached before the specimen breaks by the initial cross sectional area of the specimen of the material. Id. at 66. In addition to strength, it is critical that the selected material have an appropriate strength-to-weight ratio so that the completed snowshoe will not weigh too much. The previously available devices have not recognized the advantages of using high strength materials but rather utilized lower strength materials which cost less and which require greater bulk and less desirable performance.

While many materials can be used within the scope of the present invention, the use of appropriate aluminum alloys is presently preferred for the frame. It is preferred that one of the, 7000 series aluminum alloys utilizing zinc as the principal alloying element formed as tubes be used as the material for the frame. To obtain the desired strength, temper must be considered as well.

As used herein, the strength characteristics are intended to be the strength characteristics obtained by testing the material before it is formed into the shape of the structural members which will form the frame.

One particular, material which is most preferred for use in the frame structures represented in FIGS. 1–13 is an aluminum alloy referred to in the industry as T7075. The T7075 aluminum alloy is widely available to those skilled in the art and is used where a high strength material is needed while maintaining a high strength to weight ratio. These characteristics allow the advantages of small diameter tubing to be used in the frame while maintaining the strength and rigidity of the snowshoe frame.

While the T7075 aluminum alloy is preferred for use in the snowshoe frames described herein, other materials having the appropriate strength characteristics can also be used. For example, it is preferred that the material used for the snowshoe frames illustrated herein have a yield strength of at least 35 ksi, more preferably have a yield strength of at least 45 ksi, and most particularly have a yield strength of at least 55 ksi. The yield strength of materials can be determined using well known techniques in the industry. It is also preferred that the material used for the snowshoe frames illustrated herein have a tensile strength of at least 30 ksi, more preferably have a yield strength of at least 40 ksi, and most particularly have a yield strength of at least 50 ksi. The tensile strength of materials can be determined using well known techniques in the industry.

In the case of the preferred T7075 aluminum alloy, it is preferred that the material be tempered to provide at least the preferred yield strength. For example, in the case of the preferred T7075 aluminum alloy, it is preferred that the standard tempers designated T6 or T651 be utilized for best results. It will be appreciated that utilizing materials having the specified strength provides a snowshoe frame which can provide the desirable characteristics of low weight so that the user is not fatigued more than is necessary as well as providing the needed strength, rigidity, and toughness needed for reliable and desirable operation.

Using a cylindrical tubular material having the strength characteristics described above is preferred and one preferred size of tubing for use in the fabrication of the snowshoe frames disclosed herein is ½ inch in diameter having a wall thickness of 1/32 inch. The small diameter of the tubing for the frame members provides advantages such as reducing the space occupied when the snowshoe frame is collapsed, improving the ease of assembly of the snowshoe frame, producing an aesthetically pleasing snowshoe, and making assembly and disassembly more efficient. Other sizes and shapes of frame segments can also be used within the scope of the present invention. For example, it is also preferred that tubing having a diameter of one inch be utilized tubing and it is even further preferred that tubing having a diameter of three-quarters inch be utilized. Moreover, other materials can also be used to construct the snowshoe frame within the scope of the present invention.

FIG. 2 provides an exploded perspective of the snowshoe frame 100 which has been disassembled along with a deck 170 and a binding, which is generally designated at 150. The binding is attached to the binding plate (130 in FIG. 1) by fasteners 152 (see FIG. 3). The deck 170 is attached to the frame 100 as will be explained hereinafter.

As illustrated in FIG. 2, the frame 100 can be readily assembled by insertion of an end of a segment into the open end of an adjacent segment. The dashed lines in FIG. 2 indicate the insertion of one segment into an adjacent segment. Frame segment 108 is provided with a post 108A which is received into the open end of frame segment 110. Similarly, post 110A is received into the open end of frame segment 112. Frame segments 104 and 102 are provided with posts 104A and 102A, respectively, which are also received into the open ends of frame segments 102 and 120, respectively.

A nose segment 116 is provided with two tubes 114 and 118 which receive the end of frame segments 112 and 120, respectively. Each end of a tail segment 106 is received into a corresponding end of frame segments 104 and 108.

The illustrated means for selectively interconnecting and disconnecting the frame segments provides a simple and strong structure which can be readily assembled and disassembled. With the other structures described herein, the frame 100 is held in its assembled form without any additional holding structures. If necessary, the components which comprise the frame are provided with locking structures within the scope of the present invention. It will also be appreciated that the posts shown in the figures used to interconnect the frame segments are fabricated from tubular material having similar strength characteristics as those strength characteristics described earlier and that the fit between the posts and the accommodating openings in the frame segments are tightly received therein.

The general shape of the snowshoe and the frame 100 represented in FIGS. 1–4 is preferred and provides good performance on a variety of snow conditions. Other shapes for the frame 100 and the assembled snowshoe can also be used within the scope of the present invention.

The deck 170 is preferably made from a coated fabric material which is strong, lightweight, and is not harmfully affected by moisture and cold. An aperture 172 is provided in the deck 170 to allow for pivoting movement of the binding 150.

The forward portion of the deck 170 is attached to the frame 100 by loops 170A through which frame segments 112, 116, and 120 pass. The loops 170A are preferably positioned so that they hold the frame segments together to form the frame 100. The loops 170A are preferably formed by bending the deck 170 upon itself and securing with rivets 170B to form the loops 170A.

Figure 3:
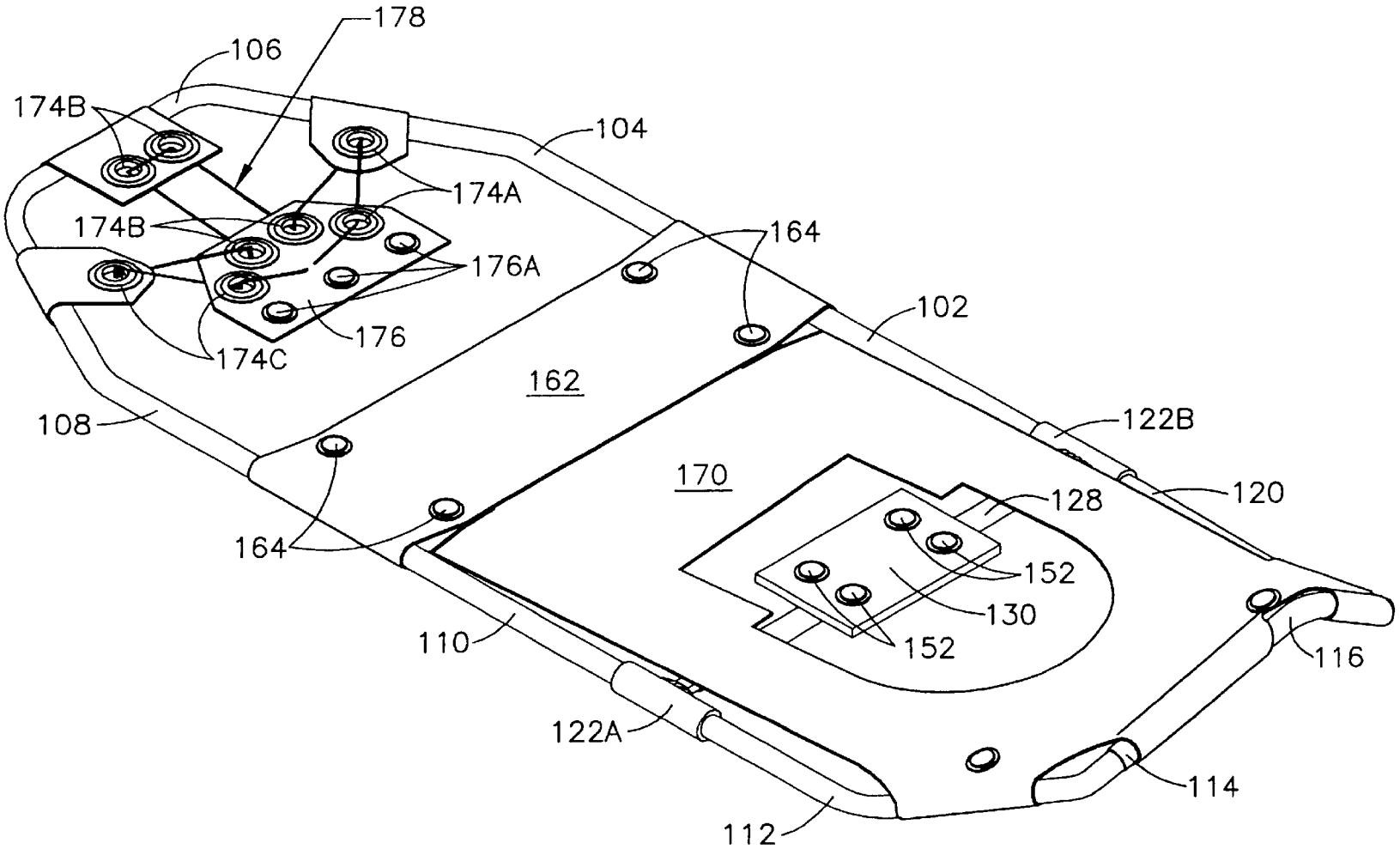
FIG. 3 is a perspective view of the assembled snowshoe frame and deck illustrated in FIG. 2.

The deck 170 is also provided with grommets 174A, 174B, and 174C. Some of the grommets 174A, 174B, and 174C are positioned on a grommet flap 176 which is secured to the deck 170 by rivets 176A. After the deck 170 is positioned on the frame 100, the grommets 174A, 174B, and 174C are pulled together by a lace which is shown at 178 in FIG. 3. The lace 178 is tightened as illustrated in FIG. 3 so that the frame is held together and the deck 170 is taught and will resist the upward pressure of the snow.

A lateral support 162 is preferably fabricated from the same material as the deck 170. The ends of the lateral support 162 are bent upon themselves and fastened by rivets 164 to form loops 162A. The lateral support 162 functions to hold the deck 170 in position against the pressure of the snow and to further hold the frame members formed by frame segments 108 and 110 and 104 and 102 in their preferred parallel relationship.

The binding 150 is exemplary of a number of preferred bindings which can be selected using the information set forth herein. The binding 150 includes a plurality of instep straps, indicated at bracket 156, which are each provided with a grommet such as grommet 156A. A toe strap 154 is likewise provided with a grommet 154A. A lace (166 in FIG. 4) is provided to tighten the straps 154 and 156 about the user's boot (not illustrated). A heel strap 158 is provided with a buckle 160. The binding 150 is attached to the binding plate (130 in FIG. 1) using rivets 152. As indicated earlier, the binding plate 130 pivots about the interconnecting member 128.

Using the preferred dimensions provided above for the frame considered, it will be appreciated that the surface area of the deck structures illustrated herein are preferably in the range from eighty-four square inches to about four hundred thirty-two square inches, more preferably in the range from about one hundred twenty-six square inches to about three hundred thirty square inches, and most preferably in the range from about one hundred sixty square inches to about three hundred square inches. Depending upon the characteristics of the user and the contemplated end use of the snowshoe, the surface area of the decks illustrated herein can be selected.

FIG. 3 provides a perspective view of the frame 100, deck 170 and lateral support 162 assembled together ready for use but without the binding 150 represented in FIG. 2. The lace 178 is shown in its preferred lacing pattern.

FIG. 4 provides a perspective view of the frame 100, deck, and lateral support as in FIG. 3 with the preferred binding 150 attached to the binding plate and the lace 166 shown in its preferred lacing pattern.

Figures 5A, 5B:
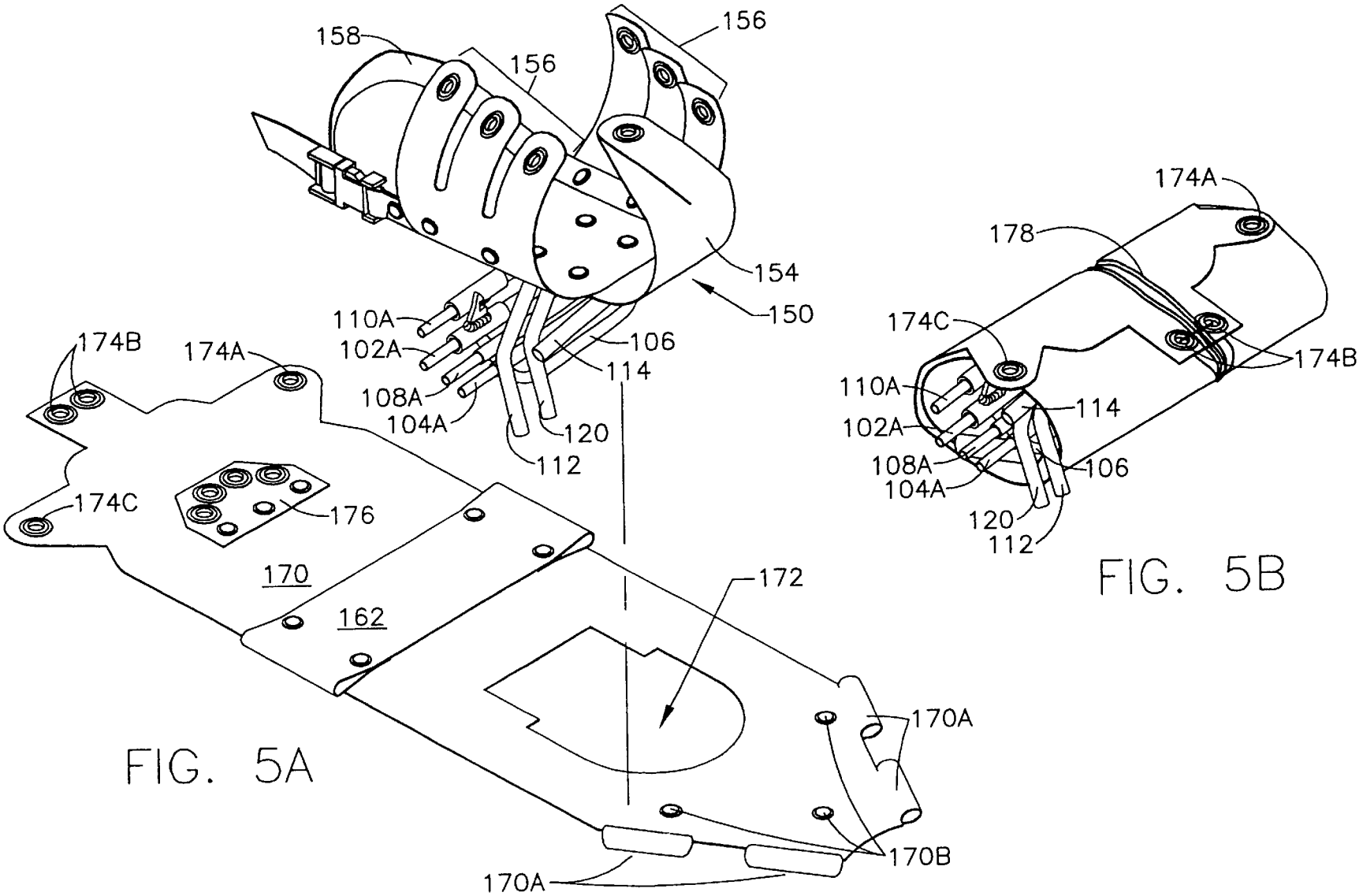
FIGS. 5A and 5B are perspective views of the embodiment illustrated in FIG. 4 shown in a storage configuration.

Reference will next be made to FIG. 5A which illustrates the snowshoe in its disassembled configuration.

Each of the frame segments 104, 106, 108, 110, 112, 116, and 120 have been disassembled and gathered together leaving the deck 170 and the lateral support 162 free. FIG. 5B shows the deck 170 which has been wrapped around the frame segments 104, 106, 108, 110, 112, 116, and 120, the binding 150, and the lateral support 162 and tied together with the lace 178 to form a compact bundle which can be easily stored on a snowmobile, in a backpack, or any other location where it is conveniently stored until it is needed. In accordance with the present invention, the bundle illustrated in FIG. 5B has dimensions no greater than about fourteen inches by about six inches by about five inches, preferably no greater than about eleven inches by about six inches by about five inches and most preferably about nine inches by about five inches by about four inches. It will be appreciated that even small reductions in the size of a disassembled, compact snowshoe is important in the limited storage volumes available in a snowmobile or a backpack.

Figure 6:
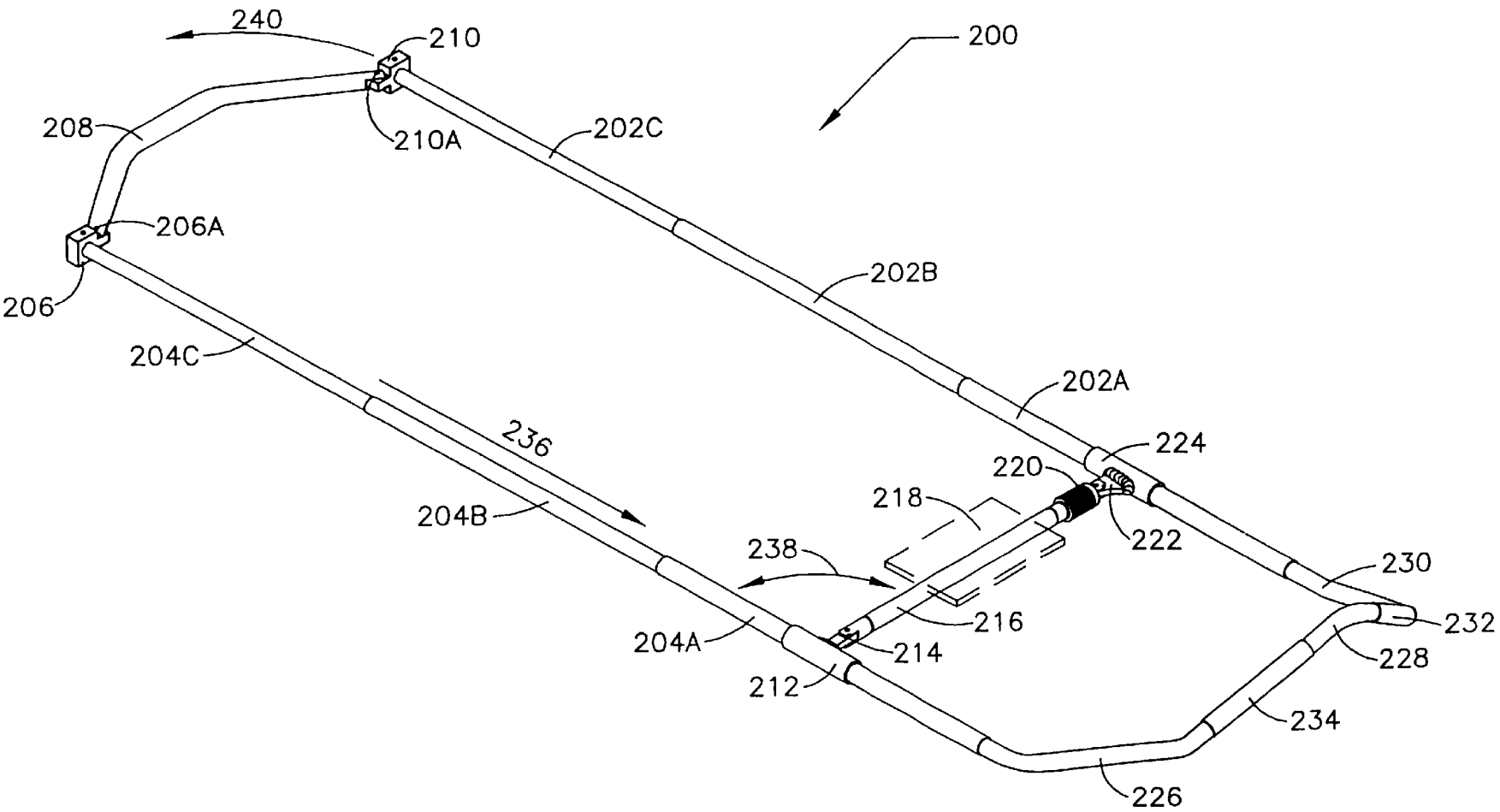
FIG. 6 is a perspective view of a snowshoe frame of a second presently preferred embodiment of the present invention.

Reference will next be made to FIG. 6 which is an illustration of a snowshoe frame, generally designated at 200, of a second presently preferred embodiment of the present invention. Similarly to the frame 100 represented in FIGS. 1–5, the frame 200 also collapses to allow compact and convenient storage until the snowshoe is needed. The dimensional and strength considerations discussed above also apply to the frame 200 as well as the other frames described herein.

The side members of the frame 200 comprise frame segments 202A, 202B and 202C and 204A, 204B and 204C, respectively. The side members of the frame 200 telescopically collapse into each other in the direction of arrow 236 when in the stored configuration and telescopically extend in the opposite direction when the snowshoe is to be used. As will be appreciated, the frame 200 provides for very easy assembly and disassembly of the snowshoe and reduces the likelihood of any frame segments becoming lost.

The frame segment 202C telescopically slides into and out of the frame segment 202B while the frame segment 202B telescopically slides into and out of the frame segment 202A. Likewise, the frame segment 204C telescopically slides into and out of the frame segment 204B while the frame segment 204B telescopically slides into and out of the frame segment 202A. The frame 200 is preferably fabricated with the same considerations used when selecting materials and fabrication techniques for the frame 100 previously discussed. Those skilled in the pertinent art can readily fabricate the telescoping structures using the information set forth herein.

A rear frame segment 208 is attached at its ends to hinge blocks 206 and 210 by way of pivot pins 206A and 210A, respectively. Thus, when the frame 200 is collapsed, the rear frame segment can pivot in the direction of arrow 240. Alternatively, structures can be provided to allow one end of the rear frame segment to swing free of one hinge block, for example hinge block 210. An interconnecting member 216 is pivotally connected at one end to a sleeve 212 via a hinge pin 214 and is removably attached at the other end to a post 222 which is secured to a sleeve 224. A locking cylindrical knob 220 functions to selectively latch the interconnecting member 216 between the frame segments 202A and 204A in the same manner as described in connection with interconnecting member 128 illustrated in FIGS. 1 and 1A. With the described structure, the interconnecting member 216 can pivot in the directions of arrow 238. A binding plate 218 is also provided and functions as binding plate 130 illustrated in FIG. 1.

A pair of front end segments 226 and 230 are removably received into the ends of frame segments 204A and 202A, respectively. A pair of connecting tubes 232 and 234 hold a nose piece 228 in position between the front end segments 226 and 230. When the frame 200 is being collapsed during the disassembly procedure the front end segments 226 and 230 and the nose segment 228 are preferably disconnected from each other so that the frame assumes a compact bundle.

It will be appreciated that the deck 170 illustrated in FIGS. 2–3 can be used with the frame 200. Alternatively, using the information set forth herein another structure for a deck can be devised for use with the frame 200.

Figure 7:
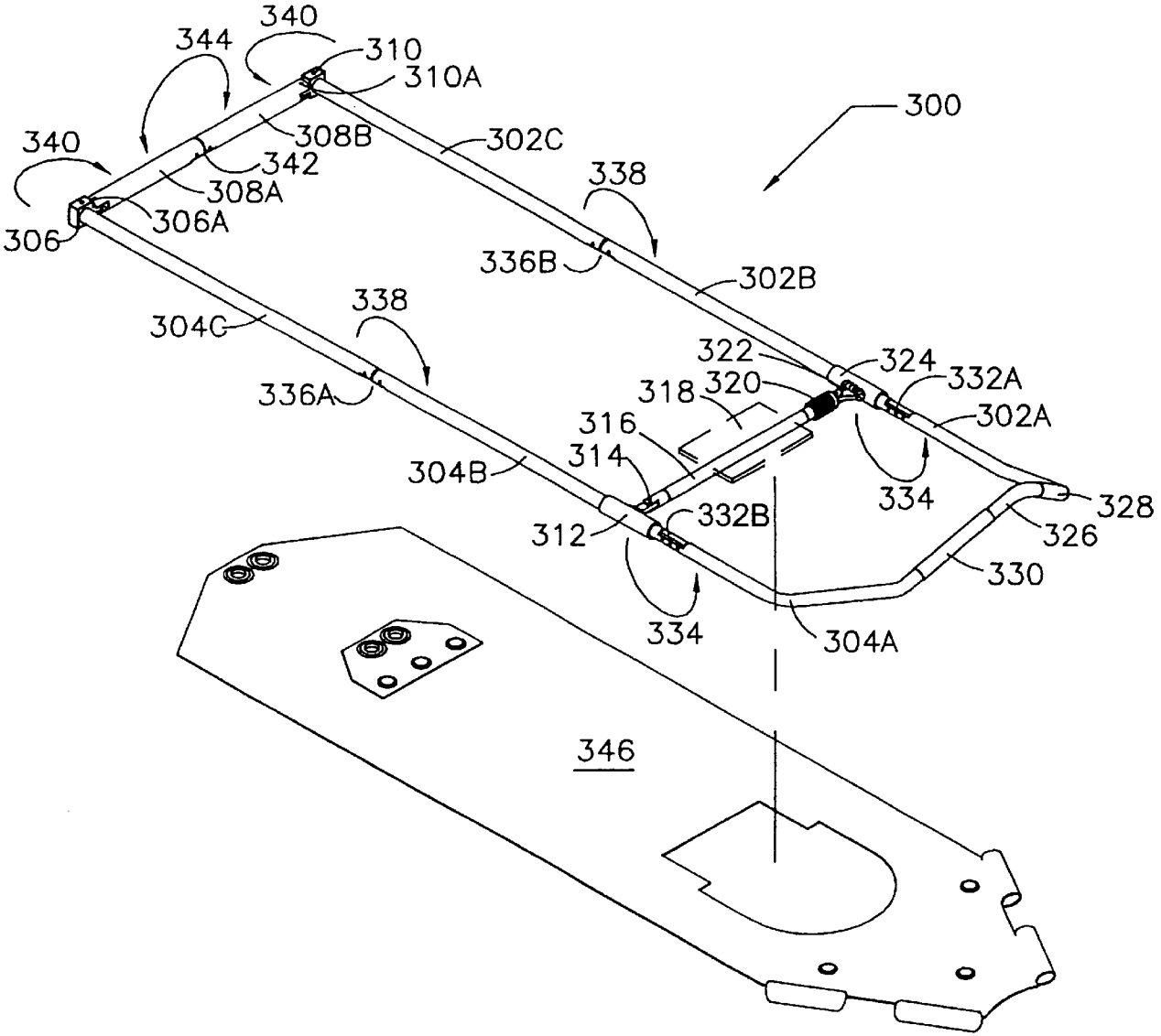
FIG. 7 is a perspective view of a snowshoe frame of a third presently preferred embodiment of the present invention.

Reference will next be made to FIG. 7 which illustrates a snowshoe frame, generally designated at 300, of a third presently preferred embodiment of the present invention. Similarly to the frame 100 represented in FIGS. 1–5, the frame 300 also collapses to allow compact and convenient storage until the snowshoe is needed.

The side members of the frame 300 comprise frame segments 302A, 302B and 302C and 304A, 304B and 304C, respectively. The side members of the frame 300 fold upon each other when in the stored configuration. The frame segments 302A and 302B and the frame segments 304A and 304B are pivotally connected by hinges 332A and 332B, respectively, which allows the frame segments to fold in the direction of arrow 334. The frame segments 302B and 302C and the frame segments 304B and 304C are pivotally connected by hinges 336A and 336B, respectively, which allows the frame segments to fold in the direction of arrow 338. As will be appreciated from considering this disclosure, the frame 300 provides for very easy assembly and disassembly of the snowshoe and reduces the likelihood of any frame segments becoming lost.

The frame 300 is preferably fabricated with the same considerations used when selecting materials and fabrication techniques for the frame 100 previously discussed. Those skilled in the pertinent art can readily fabricate the hinge structures represented in FIG. 7 using the information set forth herein.

Rear frame members 308A and 308B are pivotally connected together by way of a hinge 342 which allows the rear frame members 308A and 308B to fold in the direction of arrow 344. The rear frame segments 308A and 308B are attached at their remaining ends to hinge blocks 310 and 306 by way of pivot pins 310A and 306A, respectively. Thus, when the frame 300 is collapsed, the rear frame segments can pivot in the direction of arrows 340. Thus, when the frame 300 is collapsed the rear frame segments 308A and 308B fold upon themselves and upon the frame members 304C and 302C making a compact bundle for storage.

An interconnecting member 316 is pivotally connected at one end to a sleeve 312 via a hinge pin 314 and is removably attached at the other end to a post 322 which is secured to a sleeve 324. A locking cylindrical knob 320 functions to selectively lock the interconnecting member 316 between the frame segments 304A and 302A in the same manner as described in connection with interconnecting member 128 illustrated in FIGS. 1 and 1A. With the described structure, the interconnecting member 316 can pivot as described earlier. A binding plate 318 is also provided and functions similarly to binding plate 130 illustrated in FIG. 1.

Still referring to FIG. 7, a pair of connecting tubes 330 and 328 hold a nose piece 326 in position between the frame segments 304A and 302A. The nose piece 326 is preferably fabricated from a flexible material which allows the nose piece 326 to bend when the frame is collapsed.

A deck 346 which is particularly adapted for attachment to the frame 300 is preferably fashioned after the construction of the deck 170 illustrated in FIGS. 2–3. The frame 300 and accompanying deck 346 can be collapsed and bundled as described in connection with FIGS. 5A and 5B. The frame 300 can be readily collapsed, as part of disassembling the snowshoe and can also be easily assembled by a user even under extreme weather conditions.

Figure 8A:
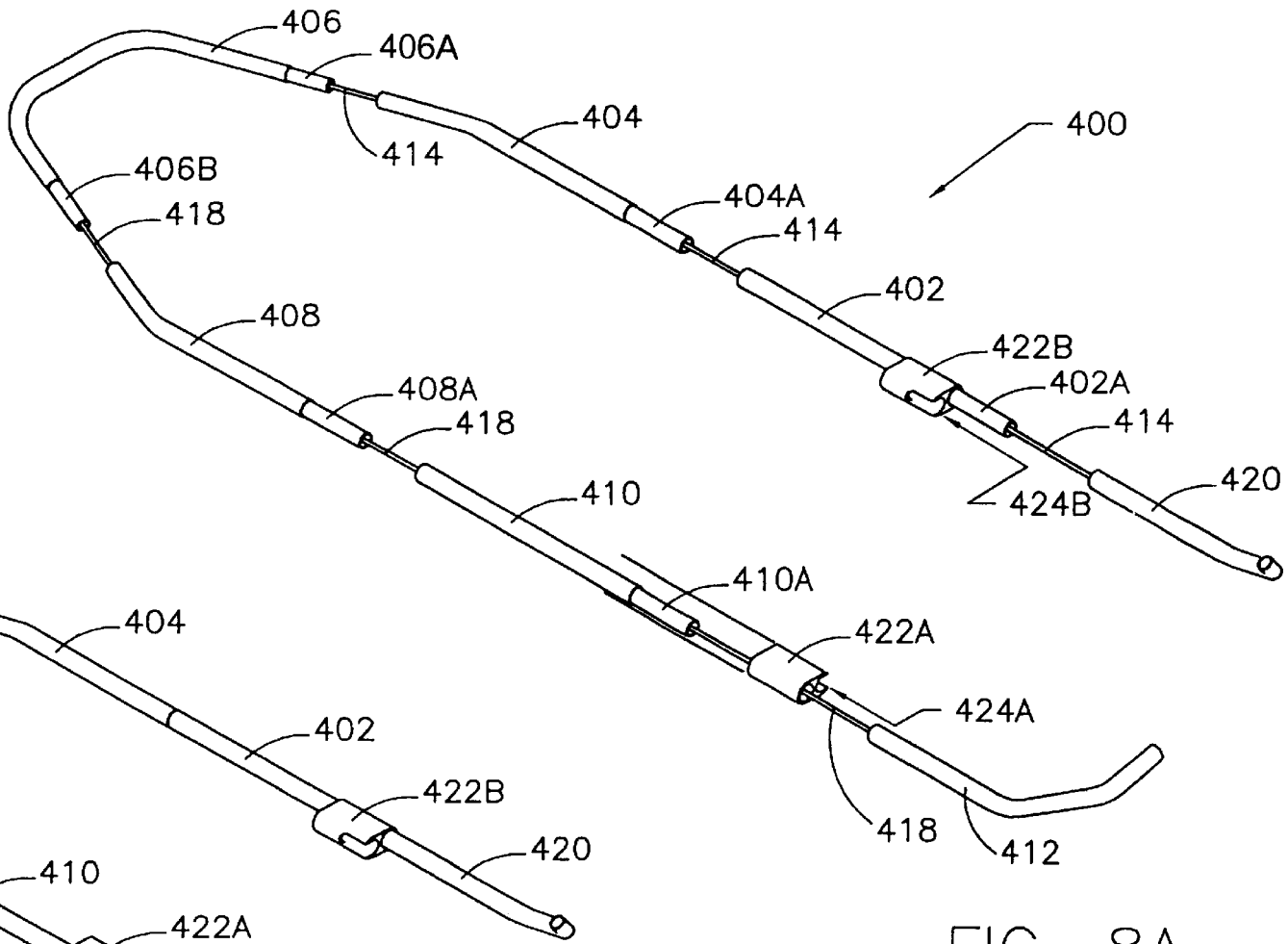
FIGS. 8A and 8B are perspective views of a snowshoe frame of a fourth presently preferred embodiment of the present invention.
Figure 8B:
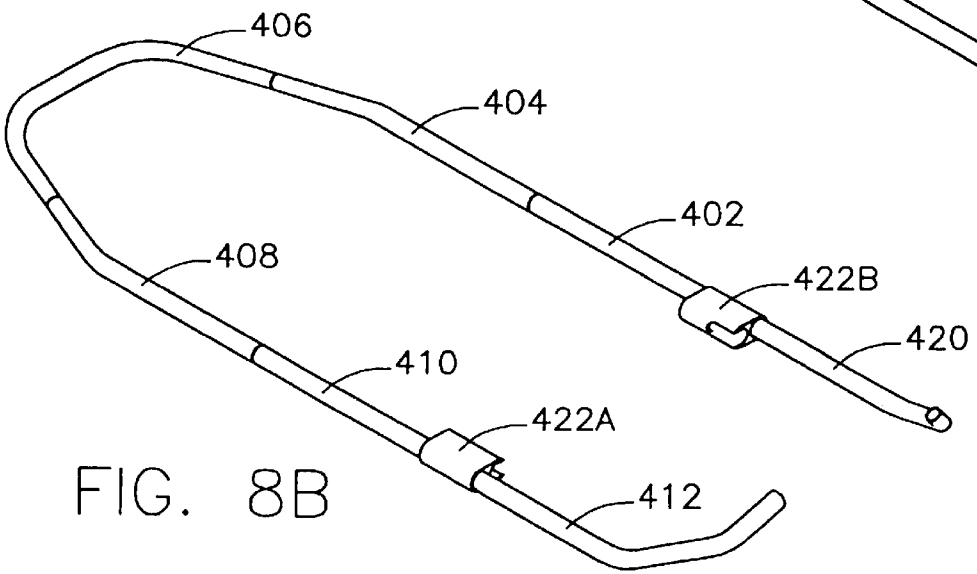

FIGS. 8A–8B, 9, 10, 11, 11A, 12, and 13 will now be referenced so that the structure and the particular advantages of the fourth presently preferred embodiment of the present invention described herein can be appreciated. FIGS. 8A and 8B provide perspective views of a compatible snowshoe frame, generally designated at 400, particularly adapted for use with the fourth presently preferred embodiment of the present invention. As will be appreciated shortly, the compactible snowshoe frame 400 functions to provide a most easily compactible and assembled snowshoe frame and providing a snowshoe frame of great strength and suitable size. Previously available snowshoes have not addressed the need to provide a strong yet light weight frame and still reduce the maximum stored length of the snowshoe frame to an extent which allows convenient storage on a snowmobile.

The compactible snowshoe frame 400 comprises a left and a right side frame members, each of the side frame members including two frame segments: a left side frame member including frame segments 402 and 404 and a right side frame member including frame segments 408 and 410. It is preferred that each of the frame segments 402 and 404 and 408 and 410 have a length in the range from about three inches to about eighteen inches with from about five inches to about twelve inches being most preferred. The length of the frame segments used in the compactible snowshoe frame 400 may be different than those lengths specifically described herein and still come within the scope of the present invention. For example, the previously provided information concerning the preferred lengths of the segments of the frame 100 is equally applicable for the compactible snowshoe frame 400 and any other embodiments of the present invention. It is preferred that the compactible snowshoe frame 400 form a closed polygon shape but it is within the scope of the present invention to utilize a frame of any shape which meets the desired performance requirements. Moreover, the previously discussed strength and dimensional characteristics are applicable to the snowshoe frame 400.

A rear segment 406 functions as a rear frame member. As illustrated in FIG. 8A, the compactible snowshoe frame 400 can be readily compacted and assembled by insertion of an end of a segment into the open end of an adjacent segment. FIG. 8A shows how the individual frame segments are joined and separated with an adjacent segment. Frame segment 402 is provided with a post 402A which is received into the open end of frame segment 420. Similarly, post 404A is received into the open end of frame segment 402. Frame segments 408 and 410 are provided with posts 408A and 410A, respectively, which are also received into the open ends of frame segments 410 and 412, respectively. Each end of the rear frame segment 406 is provided with a post 406A or 406B which are received into the open ends of frame segments 404 and 408, respectively.

To make assembly of the compactible snowshoe frame 400 most efficient and uncomplicated, elastic cords 414 and 418 are provided. It is preferred that two elastic cords 414 and 418 be provided with the ends of elastic cord 414 being secured inside the hollow interior of the frame segment 406 and the frame segment 420 and the ends of elastic cord 414 being secured inside the hollow interior of the frame segment 406 and the frame segment 412. It will be appreciated that a single elastic cord can also be used and that many different structures can also be used within the scope of the present invention to hold the frame segments together when the compactible snowshoe frame 400 is disassembled and to pull the frame segments together when assembling the compactible snowshoe frame 400.

Using the structure illustrated in FIG. 8A, the compactible snowshoe frame 400 can be readily disassembled by folding the frame segments upon an adjacent segment. The elastic cords 414 and 418 function to pull the frame~segments together so that the frame readily assembles itself as represented in FIG. 8B. A pair of segment receivers 422A and 422B secured to frame segments 410 and 402 (for example by swaging the receivers 422A and 422B onto the frame segments 412 and 402, respectively, and receive an interconnecting frame segment (428 in FIG. 9) as will be explained shortly.

Figure 10:
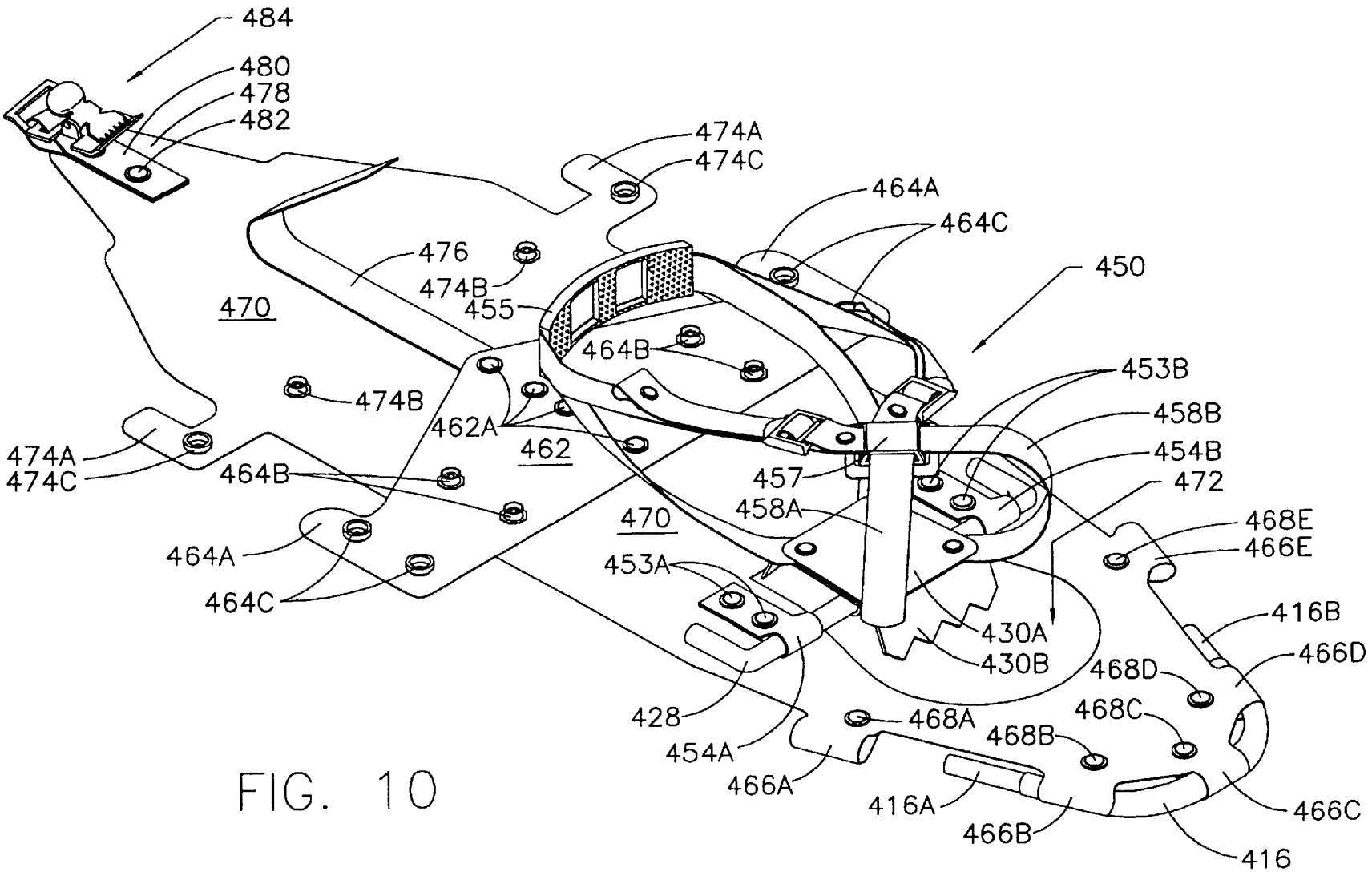
FIG. 10 is a perspective view of the snowshoe deck assembly and snowshoe binding assembly preferably included in the fourth presently preferred embodiment of the present invention.

Reference will next be made to FIG. 10. To provide most efficient assembly of the compactible snowshoe, a nose frame segment 416 is attached to a snowshoe deck 470 where it will be ready for assembly. The nose frame segment 416 is provided with two posts 416A and 416B which are inserted into the open ends of frame segments 412 and 420, respectively. With the insertion of the nose segment 416 into the adjacent frame segments, the compactible snowshoe frame (400 in FIG. 8A) is completed and ready for use when assembly is completed as further described herein. It is preferred that the compactible snowshoe frame 400 form a closed polygon shape but it is within the scope of the present invention to utilize a frame of any shape which meets the desired performance requirements.

As explained earlier, the means for selectively interconnecting and disconnecting the frame segments which are illustrated in FIG. 8A provides a simple and strong structure which can be readily assembled and disassembled. With the other structures described herein, the compactible snowshoe frame 400 is held in its assembled configuration. If necessary, the components which comprise the compactible snowshoe frame 400 can be provided with locking structures within the scope of the present invention.

Figure 9:
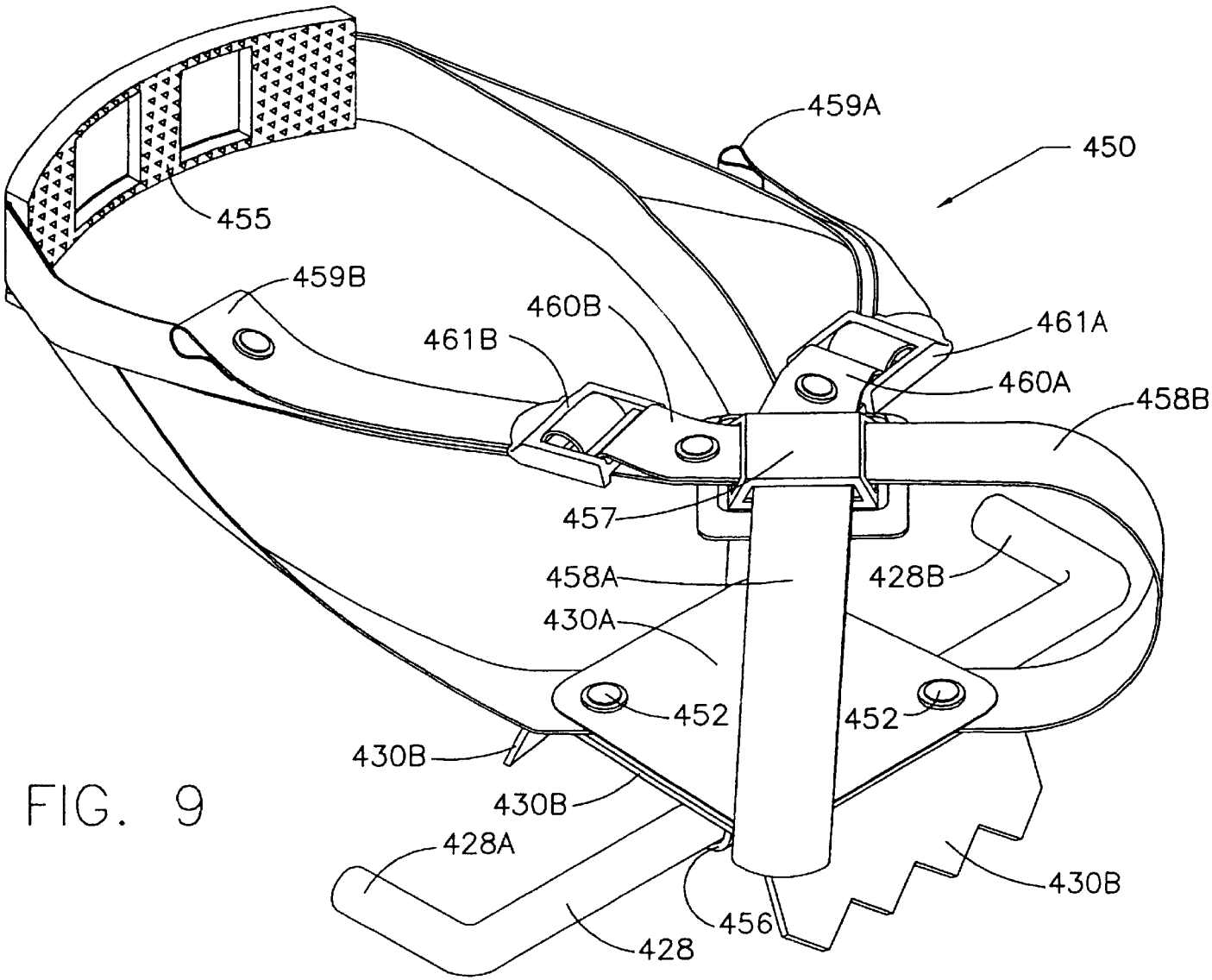
FIG. 9 is a detailed perspective view of the binding assembly preferably included in the fourth presently preferred embodiment of the present invention.

Reference will next be made to FIG. 9 to describe a snowshoe binding assembly, generally indicated at 450, which is particularly adapted for use with the fourth presently preferred embodiment of the present invention described herein. While many different binding structures can be utilized within the scope of the present invention, the binding assembly 450 provides particular advantages of being compact, readily and inexpensively manufactured, and performs well the function of holding the user's foot in the proper position.

The interconnecting segment 428 is provided with legs 428A and 428B which are received into recesses (424A and 424B in FIGS. 8A–8B), respectively, of the receivers (422A and 422B in FIGS. 8A–8B). The cooperation of the interconnecting segment 428 and the receivers (422A and 422B in FIGS. 8A–8B) will be further explained shortly. Still referring to FIG. 9, a hinge plate 456 pivotally retains the interconnecting segment 428 against the bottom of a cleat 430B which is held against a binding plate 430A using rivets 452. The cleat 430B, as it pivots on the interconnecting segment 428 as the user steps, grips the surface of the snow or ice over which the user is traveling. The binding plate 430A is formed to receive the foot of the user.

Two straps 458A and 458B are secured under the binding plate 430A and held in place by the rivets 452. Each of the straps 458A and 458B passes through a heel pad 455 which contacts the rear of the user's shoe which is being held in the snowshoe binding 450. The straps 458A and 458B are held in a crossed arrangement by a holder 457 so that the straps 458A and 458B cross about the area of the user's instep and such that the user's shoe is securely held in place on the binding plate 430A. First ends 460A and 460B of each of the straps 458A and 458B is secured to buckles 461A and 461B. Second ends 459A and 459B of each of the straps 458A and 458B are threaded through the buckles 461A and 461B such that, once the user's shoe has been inserted into the snowshoe binding 450, the second ends 459A and 459B of the straps 458A and 458B are pulled tight. The user's foot and shoe are held tightly in the snowshoe binding 450. The straps 458A and 458B can be readily loosened using buckles 461A and 461B.

It will be understood that the snowshoe binding 450 provides a means for releasably securing the user's foot and shoe to the snowshoe of the present invention. The structure allows the user's foot to pivot as the user steps and comfortably positions the user's foot on the binding plate 430A.

Reference will next be made to FIG. 10 which is a perspective, view of the snowshoe deck assembly and snowshoe binding assembly preferably included in the fourth presently preferred embodiment of the present invention. The deck 470 is preferably fabricated from a neoprene or hypalon material available in the art having a weight of about 16 or 17 ounces per square yard of material. The material from which the deck 470 is fabricated should be selected to provide suitable strength, abrasion resistance, resistance to damage by moisture, and light weight. Those skilled in the art will appreciate that many different materials are available which can be used to fabricate the deck 470 within the scope of the present invention.

In order to further ease the assembly of the deck assembly and the binding assembly 450, the interconnecting segment 428 is held captive on the deck 470 by two straps 454A and 454B. The straps 454A and 454B are preferably joined to the deck 470 by rivets 453A and 453B. As indicated earlier, the nose segment 416 is coupled to the deck 470 by a plurality of loops 466B, 466C, and 466D which are fixedly formed in the deck 470 by rivets 468B, 468C, and 468D, respectively.

Two loops 466A and 466B are also fixed in the deck 470 using rivets 468A and 468B, respectively. The loops 466A and 466B receive the frame segments 412 and 420, respectively. An interconnecting belt 462 is attached to the deck 470. A pair of releasable loops/flaps 464A which are held in place (once the frame segments are in place) by snaps 464B and 464C. Similarly, releasable loops/flaps 474A are held in place by snaps 474B and 474C.

A buckle assembly, generally indicated at 484, is attached to a tail 478 of the deck 470 via a strap 480. The strap 480 is secured to the tail 478 by a rivet 482. A strap 476 is attached to the deck 470 by rivets 462A.

Figure 11:
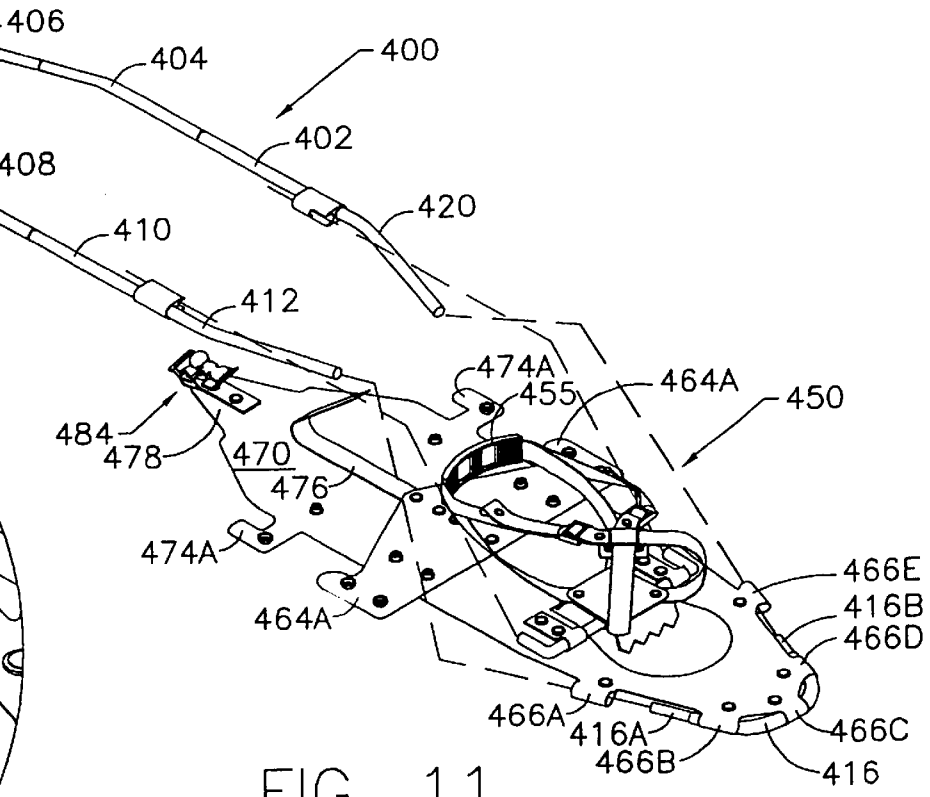
FIG. 11 is a perspective view showing the coupling of the binding assembly and deck assembly (illustrated in FIGS. 9 and 10) to the snowshoe frame (illustrated in FIGS. 8A and 8B).

FIG. 11 will be referred to next to explain the coupling of the snowshoe frame 400 with the deck 470. FIG. 11 shows the snowshoe frame 400 completely assembled except for the connection of the nose segment 416. As represented in FIG. 11, the frame segments 412 and 420 are inserted through loops 466A and 466E, respectively. The posts 416A and 416B are inserted into the open ends of the frame segments 412 and 420, respectively.

Figure 11A:
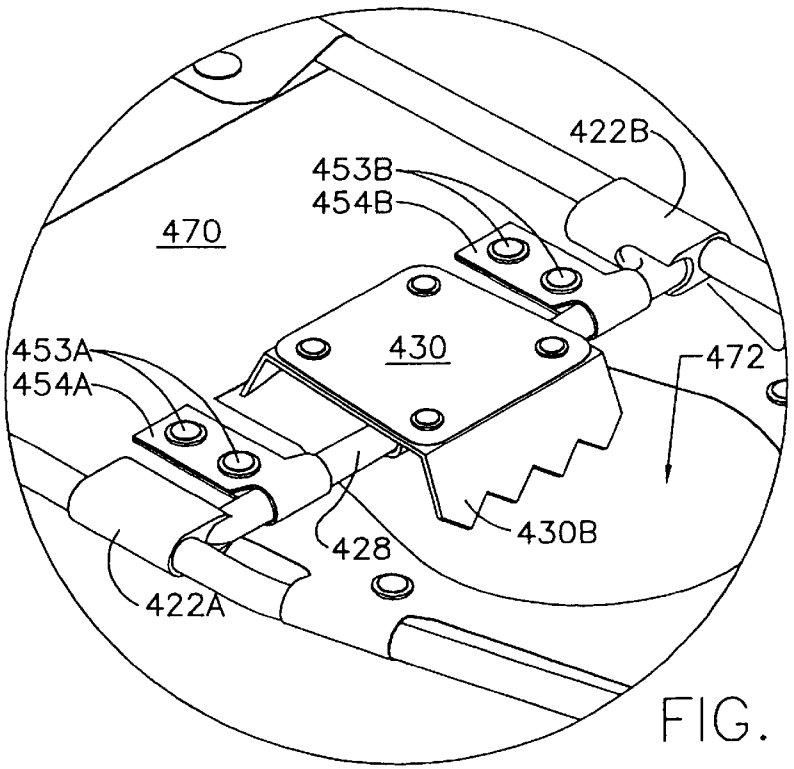
FIG. 11A is a detailed perspective view of the coupled binding assembly and snowshoe frame.

Referring now to the detailed view of FIG. 11A, the legs of the interconnecting segment 428 are positioned in the receivers 422A and 422B. As can be seen best in FIG. 11A, an aperture 472 is provided in the deck 470 to allow the cleat 430B to contact the underlying surface.

Once the snowshoe frame 400 has assumed the configuration indicated in FIG. 11, loops 464A and 474A are formed using snaps 464B, 464C and 474B, 474C, respectively. The snaps can preferably be those available from Scovill Fasteners, Inc. of Clarkesville, Ga. and referred to as PULL-THE-DOT® style snap and comprising a cap (part no. 92-18100), socket (part no. 92-18201), stud (part no. 92-18303), and post (part no. 93-10412). These preferred snaps are a heavy-duty, three sided locking snap fastener that remains locked even when pressure is applied to any of three sides but releases when pulled from a fourth side. While the described snaps are most preferred for use in the described embodiment, those skilled in the art will appreciate that many different fasteners can be utilized within the scope of the present invention.

Reference will next be made to FIG. 12 which is a perspective view of the binding assembly, deck, and snowshoe frame coupled together and ready for use. The strap 476 is passed through the buckle 484. The buckle 484 is preferably one which releasably grips the strap 476 so that the strap can be pulled tighter but will not loosen unless the buckle 484 is released. As the strap 476 is pulled tighter, the tail 478 exerts pressure on the frame segment 406. In turn, the legs 428A and 428B are pulled by steps 454A and 454B into the receivers 422A and 422B. The legs 428A and 428B and the recesses (424A and 424B in FIG. 8A) are formed so that the legs 428A and 428B are securely held therein as the straps 454A and 454B exert a rearward force thereon. The force of the deck 470 pulling rearwardly on the nose segment 416 tightly holds the snowshoe frame 400 together.

The interconnecting segment 428 is held by the receivers 422A and 422B so that the sides of the snowshoe frame are braced in their parallel configuration even as they are supporting the weight of the user on the surface of a layer of snow. Likewise, the loops formed by flaps 464A on the ends of the interconnecting strap 462 further brace the sides of the snowshoe frame. The loops formed by the flaps 474A also provide additional bracing for the snowshoe frame to keep the snowshoe frame in the proper configuration when supporting the weight of the user on the surface of the snow or ice.

The snowshoe frame represented in FIGS. 8A and 8B and 12 is particularly strong and rigid while still being lighter than previously available devices. The structure of the snowshoe frame, as well as the coupling of the deck to the snowshoe frame provides such benefits of strength, rigidity, and lightness.

Figure 13:
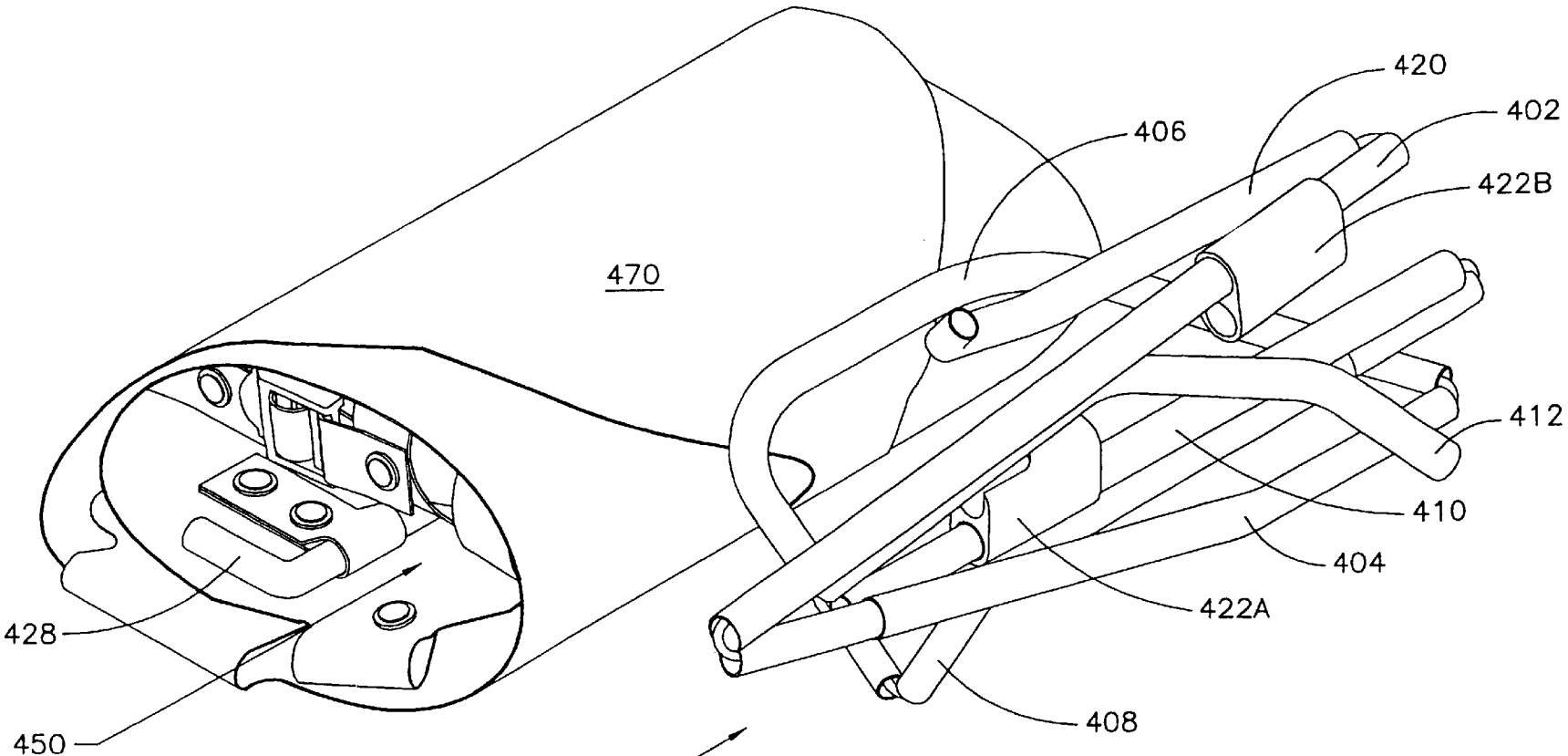
FIG. 13 is a perspective view of the fourth presently preferred embodiment of the present invention illustrated in FIGS. 8A–8B, 9, 10, 11, and 12 represented in a storage configuration.

FIG. 13 provides a perspective view of the components assembled as a snowshoe in FIG. 12 in a compacted storage configuration. The deck 470 has been rolled around the binding assembly 450 and the interconnecting segment 428 and hidden within the deck is the nose segment 416. The snowshoe frame 400 has been disassembled. Both the snowshoe frame 400 and the deck 470 with the components wrapped therein can be compactly stored in a vehicle or conveniently carried by a person.

In accordance with the present invention, the components illustrated in FIG. 13 can be stored in a receptacle having dimensions no greater than about fourteen inches by about six inches by about five inches, preferably no greater than about eleven inches by about six inches by about five inches and most preferably about nine inches by about five inches by about four inches. It will be appreciated that even small reductions in the size and weight of a disassembled, compacted snowshoe is important in the limited volumes available in a snowmobile or a backpack.

From the foregoing, it will be appreciated that the present invention provides a collapsible snowshoe which can be conveniently and compactly stored until needed and provides a collapsible snowshoe making it particularly suitable for emergency use. The present invention also provides a compactible snowshoe which provides good performance on snowy terrain, which can be used for long distance travel, and which can be easily assembled and disassembled.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed and desired to be secured by United States Letters Patent is:

1. A snowshoe comprising:

a frame formed of separable elements, having longitudinal, lateral, and transverse axes substantially orthogonal to one another, and comprising a securement mechanism:

a deck comprising a sheet of material and fasteners connected to selectively release and secure the sheet with respect to the frame; and a cross member removably securable to the securement mechanism to substantially prevent twisting of the frame about the longitudinal axis when secured hereto.

2. The snowshoe of claim 1, wherein the cross member and securement mechanism substantially prevent flexing of the frame in a plane defined by the longitudinal and lateral axes.

3. The snowshoe of claim 2, wherein the separable elements are selectively arrangable in a deployed configuration and a compacted configuration, the deployed configuration forming a loop.

4. The snowshoe of claim 3, wherein the separable elements comprise a plurality of interconnecting members.

5. The snowshoe of claim 4, wherein the deck secures to the frame at a plurality of securement locations.

6. The snowshoe of claim 5, further comprising a binding having a binding plate pivotably secured to the cross member.

7. The snowshoe of claim 6, wherein the deck is formed of a flexible material.

8. The snowshoe of claim 7, wherein the deck maintains the cross member secured to the frame.

9. The snowshoe of claim 8, wherein the cross member is secured to selected interconnecting members of the frame, thereby increasing the strength of the interconnecting members to which the cross member secures.

10. The snowshoe of claim 9, wherein the cross member is disconnected from the frame in the compacted configuration.

11. The snowshoe of claim 1, wherein the separable elements comprise a plurality of interconnecting members, the plurality of interconnecting members being selectively arrangable in a deployed configuration and a compacted configuration, the deployed configuration forming a loop.

12. The snowshoe of claim 11, further comprising a binding having a binding plate pivotably secured to the cross member.

13. The snowshoe of claim 11, wherein the cross member is disconnected from the frame when the snowshoe is in the compacted configuration.

14. A method for tensioning a compactible snowshoe, the method comprising:

providing a frame configured to be selectively arranged in a deployed configuration and a compacted configuration, the deployed configuration forming a loop and having longitudinal, lateral, and transverse axes substantially orthogonal to one another;

providing a deck lying substantially in a plane defined by the loop and securing to the frame at a plurality of locations, the deck having a unitary member integrally attached thereto; and tensioning the deck within the loop, wherein tensioning comprises, gripping the unitary member, pulling the unitary member in a longitudinal direction, and releasing the unitary member.

15. The method of claim 14, further comprising providing a lock to selectively engage and selectively disengage the unitary member.

16. The method a claim 15, wherein the deck is constructed of a flexible material.

17. A snowshoe comprising:

a frame having longitudinal lateral and transverse axes substantially orthogonal to one another;

a deck secured to the frame;

a strap having first and second ends, the first end integrally attached to the deck and the second end disposed to pass around the frame and return to the deck; and a lock secured to the deck to selectively engage and disengage the second end of the strap to tension the deck with respect to the frame.

18. The snowshoe of claim 17, wherein the lock engages the strap allowing motion of the strap in substantially one direction, the lock being manually disengaged from the strap.

19. The snowshoe of claim 18, wherein the frame comprises a plurality of members readily and selectively attachable and detachable with respect to one another, the members forming a loop when attached to one another.

* * * * *